US008905148B2

(12) United States Patent
Nelson et al.

(10) Patent No.: US 8,905,148 B2
(45) Date of Patent: Dec. 9, 2014

(54) FORCE MONITORING TRACTOR

(75) Inventors: Keith R. Nelson, Sugar Land, TX (US); Gohar Saeed, Stafford, TX (US); Franz Aguirre, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 449 days.

(21) Appl. No.: 12/434,108

(22) Filed: May 1, 2009

(65) Prior Publication Data

US 2009/0236101 A1 Sep. 24, 2009

Related U.S. Application Data

(63) Continuation-in-part of application No. 12/396,936, filed on Mar. 3, 2009, now Pat. No. 7,854,258, which is a continuation of application No. 11/610,143, filed on Dec. 13, 2006, now Pat. No. 7,516,782.

(60) Provisional application No. 60/771,659, filed on Feb. 9, 2006.

(51) Int. Cl.

| | |
|---|---|
| ***E21B 23/00*** | (2006.01) |
| ***E21B 4/18*** | (2006.01) |
| ***E21B 17/10*** | (2006.01) |
| ***E21B 23/14*** | (2006.01) |

(52) U.S. Cl.

CPC ..... *E21B 4/18* (2013.01); *E21B 2023/008* (2013.01); *E21B 17/1021* (2013.01); *E21B 23/14* (2013.01)

USPC ..... 166/382; 166/98

(58) Field of Classification Search

USPC ..... 166/301, 98, 178, 382, 206

See application file for complete search history.

(56) References Cited

U.S. PATENT DOCUMENTS

| | | | |
|---|---|---|---|
| 4,670,862 | A | 6/1987 | Staron et al. |
| 5,752,572 | A | 5/1998 | Baiden et al. |
| 5,794,703 | A | 8/1998 | Newman et al. |
| 6,082,461 | A | 7/2000 | Newman et al. |
| 6,089,323 | A | 7/2000 | Newman et al. |
| 6,179,055 | B1 | 1/2001 | Sallwasser et al. |
| 6,273,189 | B1 | 8/2001 | Gissler et al. |
| 6,345,669 | B1 | 2/2002 | Buyers et al. |
| 6,454,011 | B1 | 9/2002 | Schempf et al. |

(Continued)

FOREIGN PATENT DOCUMENTS

| | | | |
|---|---|---|---|
| CN | 1823208 | A | 8/2006 |

OTHER PUBLICATIONS

First Office Action for Chinese Application No. 201010278403.4 dated Nov. 5, 2013.

(Continued)

*Primary Examiner* — Brad Harcourt
(74) *Attorney, Agent, or Firm* — Trevor Grove

(57) ABSTRACT

A downhole tractor assembly that is configured for open-hole applications. The assembly includes a force monitoring mechanism to help monitor and control forces imparted through a drive mechanism of the tractor in real time. As such, damage to open-hole formations due to excessive tractoring forces may be minimized along with mechanical damage to the tractor. Furthermore, the drive mechanism of the tractor may include multiple sondes and bowsprings with gripping saddles specially configured for contacting the well wall across a large area in a non-point and line manner so as to avoid digging into and damaging the well wall during tractoring.

10 Claims, 6 Drawing Sheets

(56) References Cited

U.S. PATENT DOCUMENTS

| | | | |
|---|---|---|---|
| 6,675,888 | B2 | 1/2004 | Schempf et al. |
| 6,722,442 | B2 | 4/2004 | Simpson |
| 6,758,279 | B2 | 7/2004 | Moore et al. |
| 6,910,533 | B2 | 6/2005 | Guerrero |
| 6,953,086 | B2 | 10/2005 | Simpson |
| 7,048,047 | B2 | 5/2006 | Bloom et al. |
| 7,143,843 | B2 | 12/2006 | Doering et al. |
| 7,156,192 | B2 | 1/2007 | Guerrero et al. |
| 7,185,714 | B2 | 3/2007 | Doering et al. |
| 7,222,682 | B2 | 5/2007 | Doering et al. |
| 7,252,143 | B2 | 8/2007 | Sellers et al. |
| 2003/0121703 | A1* | 7/2003 | Bloom et al. ..... 175/99 |
| 2003/0173076 | A1* | 9/2003 | Sheiretov et al. ..... 166/241.1 |
| 2005/0034874 | A1 | 2/2005 | Guerrero et al. |
| 2005/0082055 | A1* | 4/2005 | Bloom et al. ..... 166/213 |
| 2005/0145415 | A1 | 7/2005 | Doering et al. |
| 2006/0249307 | A1* | 11/2006 | Ritter et al. ..... 175/40 |
| 2008/0196901 | A1 | 8/2008 | Aguirre et al. |
| 2008/0202769 | A1 | 8/2008 | Dupree et al. |

OTHER PUBLICATIONS

Chinese Search Report for Chinese Application No. 201010278403.4 dated Oct. 28, 2013.

* cited by examiner

FORCE MONITORING TRACTOR

CROSS REFERENCE TO RELATED APPLICATION(S)

This Patent Document is a continuation-in-part of prior U.S. patent application Ser. No. 12/396,936, filed on Mar. 3, 2009 now U.S. Pat. No. 7,854,258 and entitled "Self-Anchoring Device with Force Amplification", which in turn is a continuation of U.S. patent application Ser. No. 11/610,143, file on Dec. 13, 2006 now U.S. Pat. No. 7,516,782, also entitled "Self-Anchoring Device with Force Amplification", which in turn is entitled to the benefit of, and claims priority to, U.S. Provisional Patent Application Ser. No. 60/771,659 filed on Feb. 9, 2006 and entitled Self-Anchoring Device for Borehole Applications, the entire disclosures of each of which are incorporated herein by reference.

FIELD

Embodiments described herein relate to tractors for delivering tools through open-hole hydrocarbon wells. In particular, embodiments of tractors are described which employ techniques and features directed at the force exhibited between expansion mechanisms of the tractor and the uncased wall of the well.

BACKGROUND

Downhole tractors are often employed to drive a downhole tool through a horizontal or highly deviated well at an oilfield. In this manner, the tool may be positioned at a well location of interest in spite of the non-vertical nature of such wells. Different configurations of downhole tractors may be employed for use in such a well. For example, a reciprocating or "passive" tractor may be utilized which employs separate adjacent sondes with actuatable anchors for interchangeably engaging the well wall. That is, the sondes may be alternatingly immobilized with the anchors against a borehole casing at the well wall and advanced in an inchworm-like fashion through the well. Alternatively, an "active" or continuous movement tractor employing tractor arms with driven traction elements thereon may be employed. Such driven traction elements may include wheels, cams, pads, tracks, wheels or chains. With this type of tractor, the driven traction elements may be in continuous movement at the borehole casing interface, thus driving the tractor through the well.

Regardless of the tractor configuration chosen, the tractor, along with several thousand pounds of equipment, may be driven thousands of feet into the well for performance of an operation at a downhole well location of interest. In order to achieve this degree of tractoring, forces are imparted from the tractor toward the well wall through the noted anchors and/or traction elements. In theory, the tractor may thus avoid slippage and achieve the noted advancement through the well.

Unfortunately, advancement of the tractor through a well may face particular challenges when the well is of an open-hole variety as opposed to the above-described cased well. That is, in certain operations, the well may be uncased and defined by the exposed formation alone. In such circumstances, the well is likely to be of a variable diameter throughout. For example, it would not be uncommon to see an 8 inch well expand to over 11 inches and taper back to about 8 inches intermittently over the course of a few thousand feet. Thus, without the reliability provided by a casing of uniform diameter, the tractor is left with the proposition of radial expansion to interface a changing diameter of the open hole well wall in order to maintain tractoring.

In order to ensure that the radial expansion is sufficient to maintain tractoring in an open hole, an excess of expansion forces may be employed. So, with reference to the well above for example, the amount of force imparted on the tractoring mechanisms (e.g. anchor or bowspring arms) may be pre-set at an amount sufficient to expand and drive the tractor through an 11 inch diameter section of the well. Thus, the tractor may be expected to avoid slippage when the well diameter begins to expand from 8 inches up to 11 inches.

Unfortunately, while excess expansion force may ensure tractoring through larger diameter sections of the open hole well, this technique may also lead to damaging of the tractor. For example, a conventional tractor may be equipped with anchor arms configured to withstand maximum forces of about 5,000 lbs. However, in a circumstance where the anchor arms are pre-set to operate at about 4,500 lbs. through an 11 inch diameter open hole well, forces well in excess of 5,000 lbs. may be imparted on the arms as the tractor traverses 8 inch well sections as noted above. Mechanical failure of the tractor is thus likely to ensue as a result of over-stressed anchor arms.

Furthermore, even in circumstances where the anchor arms or other expansive mechanisms are of sufficient strength and durability to withstand excess forces as noted, the exposed formation defining the well may not be. That is, in many circumstances the application of excess force may result in damage to the exposed well wall when its compressive strength is exceeded. Thus, where the formation is comparatively soft in nature, the utilization of forces adequate to drive the tractor through an 11 inch diameter well section may damage an 8 inch diameter section. Nevertheless, the utilization of excess force is often employed to help ensure tractoring through a variable diameter open hole well is achieved. As a result, the well wall often collapses or cracks in certain locations even where the tractor is left undamaged. In fact, even though technically undamaged, the tractor may be rendered inoperable with its expansion mechanism imbedded within a collapsed section of the well. In such circumstances, not only is tractoring halted, but a follow-on high cost fishing operation may be required.

SUMMARY

A tractor assembly for use in an open hole well is described. The assembly includes an elongated body with a driving mechanism coupled thereto for interfacing a wall of the well. A force monitoring mechanism is also provided that is coupled to the driving mechanism to monitor force thereon during the engaging.

DETAILED DESCRIPTION

Embodiments are described with reference to certain open-hole tractor assemblies. Focus is drawn to tractor assemblies that are of multiple sonde configurations. In particular, a reciprocating sonde type tractor employed in a downhole logging application is depicted with reference to embodiments described herein. However, a variety of tractor types and applications may be employed in accordance with embodiments of the present application. Regardless, embodiments detailed herein include a tractor that employs force monitoring techniques and features particularly suited for use in open-hole wells. As such, the structural integrity of the well may be substantially maintained over the course of tractoring operations. That is, forces may be employed in driving the tractor which are monitored and maintained at a level sufficient for driving without exceeding the ultimate compressive strength of the well wall resulting in substantial shearing thereat.

Figure 1:
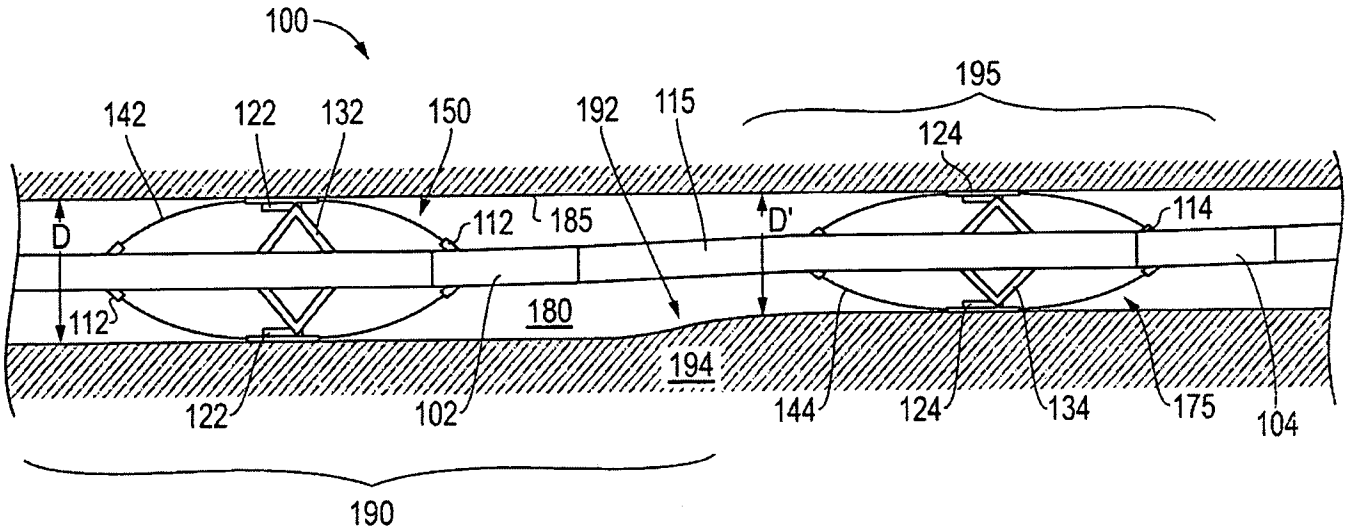
FIG. 1 is a side cross-sectional view of an embodiment of a force monitoring tractor disposed in an open-hole well.

Referring now to FIG. 1, a side cross-sectional view of an embodiment of a force monitoring tractor 100 is depicted disposed within an open-hole well 180. In the embodiment shown, the tractor 100 is of a multiple sonde variety with an uphole sonde 150 and a downhole sonde 175 to interface the well wall 185 and serve as the driving mechanism for the tractor 100. However, in other embodiments other types of tractor configurations, such as those employing tracks, wheels, chains, or pads as the tractor driving mechanism may be employed.

FIG. 1 reveals a variability in well diameter which is not uncommon to open-hole wells. For example, an uphole portion 190 of the well 180 is of a greater diameter (D) than the diameter (D') of a downhole portion 195 of the well 180. Furthermore, in the case of an open-hole well 180, the well wall 185 is no more than an exposed surface of the formation 194. Together, the combination of exposed formation 194 and smaller diameter (D') well portions leave the well 180 particularly susceptible to collapse and/or damage during intervention applications. However, as detailed below, the tractor 100 shown in FIG. 1 is equipped with a force monitoring capacity to control forces applied to the well wall 185 during tractoring through smaller diameter (D') well portions (e.g. at 195). Additionally, the tractor 100 may include gripping saddles 122, 124 configured to spread out the physical interfacing of the tractor 100 and well wall 185 over a greater area. In this manner, the likelihood of damage to the well wall 185 due to the forceful contact of the tractor 100 may be minimized.

Continuing with reference to FIG. 1, the tractor 100 is made up of an elongated body 115 or shaft to accommodate each sonde 150, 175. The sondes 150, 175 in turn are made up of bowsprings 142, 144 which are coupled to the body 115 via movable couplings 112, 114 as shown. Radially expandable arms 132, 134 are disposed between the couplings 112, 114 of each bowspring 142, 144 to forcibly engage the well wall 185 in an alternating fashion. As such, the tractor 100 may proceed downhole in an inchworm-like manner. Such is the nature of a reciprocating tractor 100 of multiple sonde configuration.

As noted above, the well 180 is of an open-hole variety. As such, the emergence of a step 192 or change in well morphology and/or diameter (e.g. (D) vs. (D')) may be a common occurrence. With this in mind, the tractor 100 is also equipped with force monitoring mechanisms 102, 104 associated with each sonde 150, 175. As detailed further below, these mechanisms 102, 104 may be employed to help ensure that the forcible engagement directed by the expandable arms 132, 134 does not exceed a predetermined amount, irrespective of the well diameter at any given location. As such, the structural integrity of the open-hole well 180 may be largely left intact, in spite of the noted tractoring.

Figure 2:
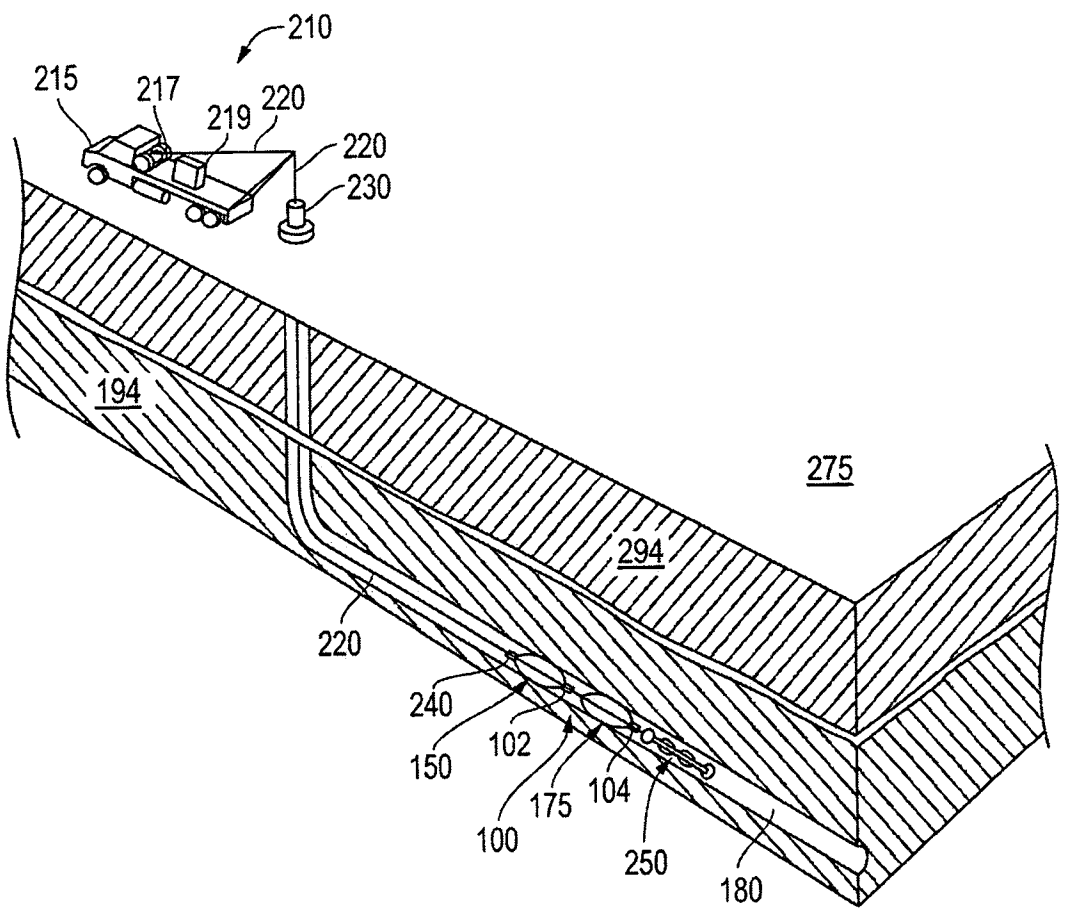
FIG. 2 is a perspective overview of an oilfield accommodating the open-hole well with force monitoring tractor of FIG. 1.

Referring now to FIG. 2, a larger overview of the tractoring is depicted. In this depiction it is apparent that the open hole well 180 runs through the formation 194 well below other formation layers 294 at an oilfield 275. In the embodiment shown, the tractor 100 is deployed from the surface of the oilfield 275 via a conventional wireline 220. However, other forms of well access line may be employed. As shown in FIG. 2, several thousand feet of wireline 220 may be run from wireline equipment 210 through a wellhead 230 at the oilfield 275 and to the tractor 100 as shown. The equipment may include a conventional wireline truck 215 configured to accommodate a drum 217 from which the wireline 220 may be drawn. In the embodiment shown, control equipment 219 is also provided by way of the truck 215 to direct the deployment of the wireline 220 and associated tractoring.

A reciprocating tractor 100 may be particularly adept at delivering a downhole tool 250 to a location as shown in FIG. 2. For example, the location may be of relatively challenging access such as a horizontal well section several thousand feet below surface as depicted. In such circumstances, the amount of load pulled by the tractor 100 may exceed several thousand pounds and continually increase as the tractor 100 advances deeper and deeper into the well 180. However, the tractor 100 may be adequately powered by the wireline 220 and secured thereto through a conventional logging head 240. Thus, tractoring may proceed with the uphole sonde 150 and downhole sonde 175 interchangeably grabbing and gliding relative to the well wall so as to pull the entire assembly further and further downhole. So, for example, logging of the well 180 may proceed in an embodiment where the downhole tool 250 is a logging tool. Once more, due to the force monitoring mechanisms 102, 104 associated with the sondes 150, 175, the logging application may take place without substantial damage to the open hole well 180 as a result of the tractoring.

Figure 3:
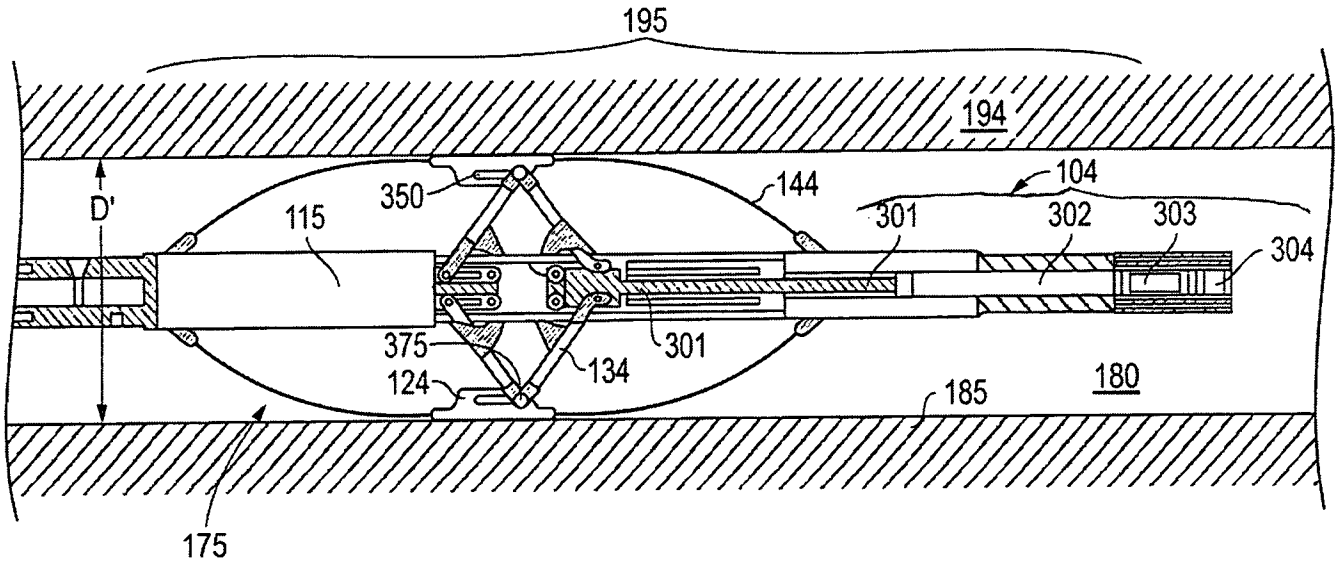
FIG. 3 is an enlarged cross-sectional view of a downhole sonde of the force monitoring tractor of FIG. 1 in the open-hole well.

Referring now to FIG. 3, an enlarged cross-sectional view of the downhole sonde 175 is depicted within the smaller diameter (D') downhole portion 195 of the well 180. The force monitoring mechanism 104 of the sonde 175 may play a significant role in regulating the physical interaction of the sonde 175 and the well wall 185. That is, consider that the bowsprings 144 of the sonde 175 may be set to expand for gripping the wall 185. However, the diameter (D') of the well 180 is reduced in the downhole portion 195. Thus, the force monitoring mechanism 104 may be employed to ensure that the force of this expansion does not exceed a predetermined amount. In this manner, damage to the exposed well wall 185 may be avoided as the gripping saddles 124 of the bowsprings 144 grab hold of the wall 185 for pulling the assembly downhole.

Continuing with reference to FIG. 3, the force monitoring mechanism 104 includes a pressure sensor 303 such as a transducer for monitoring the pressure and/or force translated through the bowsprings 144 during operation. More specifically, the pressure sensor 303 may be coupled to a hydraulic chamber 302 that is in communication with a piston 301. While the depicted force monitoring mechanism 104 is pressure-based, alternate embodiments may be strain gauge based or include other suitable detection mechanisms.

As shown, the piston 301 may be directly coupled to the radially expandable arms 134 that forcibly control the interfacing of the bowsprings 144 and the wall 185. Thus, as the diameter (D') of the well 180 decreases and the force on the bowsprings 144 increases, the piston 301 may be forced toward the chamber 302. As such, hydraulic pressure in the chamber 302 may be driven up in a manner detectable by the pressure sensor 303. In one embodiment, the pressure in the chamber may be in the neighborhood of 7,500-12,500 psi. Such pressure may be recorded and interpolated by a downhole processor 304 as described below to determine roughly the amount of force translating through the bowsprings 144.

The force information obtained by the pressure sensor 303 may be employed in a variety of manners. For example, the sensor 303 may be coupled to a downhole processor 304 as indicated. Thus, the information may be recorded and relayed uphole (e.g. over the wireline 220 of FIG. 2). In this manner, well diameter and/or sonde and tractor location information may be retrieved and utilized. That is, by having a predetermined map of the well 180 geometry knowing the well diameter may be used to determine the tractor location. Additionally, as indicated above, the information may be employed to control the amount of force translated through the bowsprings 144 so as to minimize damage to the well wall 185 during tractoring. For example, upon acquiring information indicative of forces exceeding a predetermined amount, the processor 304 may be employed to direct release of fluid from the chamber 302 via conventional means. In this manner, the pressure on the piston 301, and ultimately the forces translated through the bowsprings 144, may be reduced.

With added reference to FIGS. 1 and 2, the tractor 100 may be configured to pull a load of several thousand pounds to deep within the well 180. Thus, sufficient forces necessary for tractoring are to be employed. However, given the exposed, open-hole nature of the well 180, the tractor 100 may also be configured to avoid excessive translation of forces through any of the bowsprings 142, 144 to the well wall 185. With reference to controlling forces through these bowsprings 142, 144, a more specific illustration is described below.

In one embodiment, a predetermined target of about 5,000 psi of pressure may be set to ensure a sufficient, but not damaging, amount of pressure be translated through anchored bowsprings 142, 144 during a power stroke of the respective sonde 150, 175. For example, the ultimate compressive strength of the formation 194 may be about 5,250 psi. In such an embodiment, the downhole processor 304 may effectuate a deflation or release of fluid from the chamber 302 once pressure greater than a predetermined value of about 5,000 psi are detected by the pressure sensor 303. For example, as the downhole sonde 175 moves from a 10 inch uphole portion 190 of a well 180 and into an 8 inch portion 195, pressure translated through the bowsprings 144 may initially increase. However, the release of fluid from the chamber 302 will allow pressure to return to the targeted 5,000 psi. Similarly, the processor 304 may direct inflating or filling of the chamber 302 as described below, once pressure less than about 5,000 psi are detected. All in all, a window of between about 4,800 psi and about 5,200 psi of pressure through the bowsprings 144 may be maintained throughout a powerstroke of a given sonde 175.

In the example provided above, a powerstroke is noted as the period of time in which a given sonde 150, 175 is anchored to the well wall 185 by the forces translated through the bowsprings 142, 144. It is this anchoring force that is monitored by the noted mechanisms 102, 104. At other times during reciprocation of the tractor 100, however, a given sonde 150, 175 may be intentionally allowed to glide in relation to the well wall 185. Indeed, at any given point, one sonde 150, 175 may be anchored as the other glides, thereby leading to the inchworm-like advancement of the tractor 100 downhole as alluded to earlier.

It is worth noting that during the glide of a sonde 150, 175 (e.g. it's 'return stroke'), the amount of forces translated between the bowsprings 142, 144 and the wall 185 drops to well below the window of between about 4,800 psi and about 5,200 psi, for example. Further, regulation of such forces during the return stroke may be controlled by features outside of the force monitoring mechanisms 102, 104. In another embodiment however, these mechanisms 102, 104 may be employed to initiate the glide of the sonde 150, 175 for the return stroke. Additionally, upon returning to the power stroke a brief amount of inflating of the chamber 302 may take place to allow for sufficient anchoring forces to build up therein. Such inflating may take place in conjunction with the natural reciprocation of the tractor 100.

Figure 4:
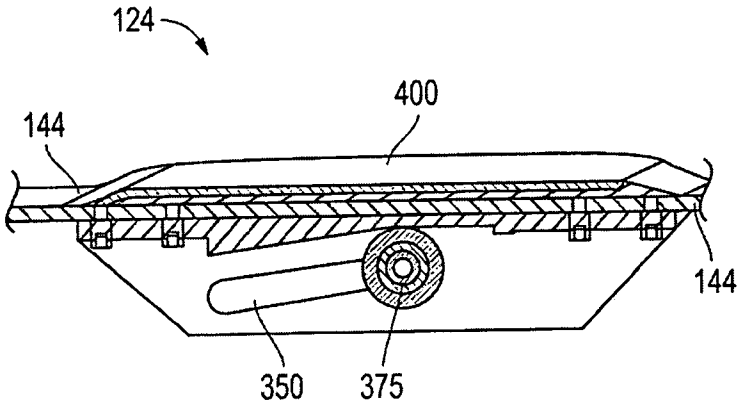
FIG. 4 is an enlarged view of a gripping saddle of the downhole sonde of the force monitoring tractor depicted in FIG. 3.

Continuing now with added reference to FIG. 4, one of the gripping saddles 124 of the downhole sonde 175 is described in greater detail. That is, in addition to employing the force monitoring mechanism 104, a specially configured gripping saddle 124 may be utilized to help minimize damage to the wall 185 of the well 180 during anchoring. In particular, the gripping saddle 124 includes a surface 400 that is configured to interface the well wall 185 across a wide area. That is, rather than provide a toothed cam or other conventional interfacing feature, the surface 400 spreads out interfacing contact between the radially forced bowspring 144 and the wall 185. Thus, a potentially damaging and forcibly induced line or point of contact between the bowspring 144 and wall 185 is avoided. Stated another way, the saddle 124 is configured to contact the wall 185 in a non-point and line manner for protection thereof In one embodiment, the surface 400 is even of a comparatively harder material such as tungsten carbide.

With added reference to FIG. 3, the gripping saddle 124 is coupled to the sonde 175 via a linkage wheel 375 of the radially expandable arms 134. As shown, the linkage wheel 375 extends from the arms 134 and through a recess 350 of the saddle 124. The recess 350 of the embodiment shown is of an inclined orientation such that downhole movement of the wheel 375 takes place in conjunction with outward radial forces of expansion on the bowspring 144. This may enhance stable anchoring during a power stroke relative to the sonde 175.

Continuing with reference to FIGS. 3 and 4, the sonde 175 is shown for interfacing, and during a power stroke, anchoring relative to the well wall 185. However, both a force monitoring mechanism 104 and a gripping saddle 124 are provided. Alone, each of these features 104, 124 may substantially avoid the collapse of the formation 194 as a result of tractoring. However, when employed in conjunction with one another, the mechanism 104 and saddle 124 may substantially eliminate all reasonable likelihood of well damage at the wall 185 due to forces imparted by the sonde 175 during tractoring.

Figure 5:
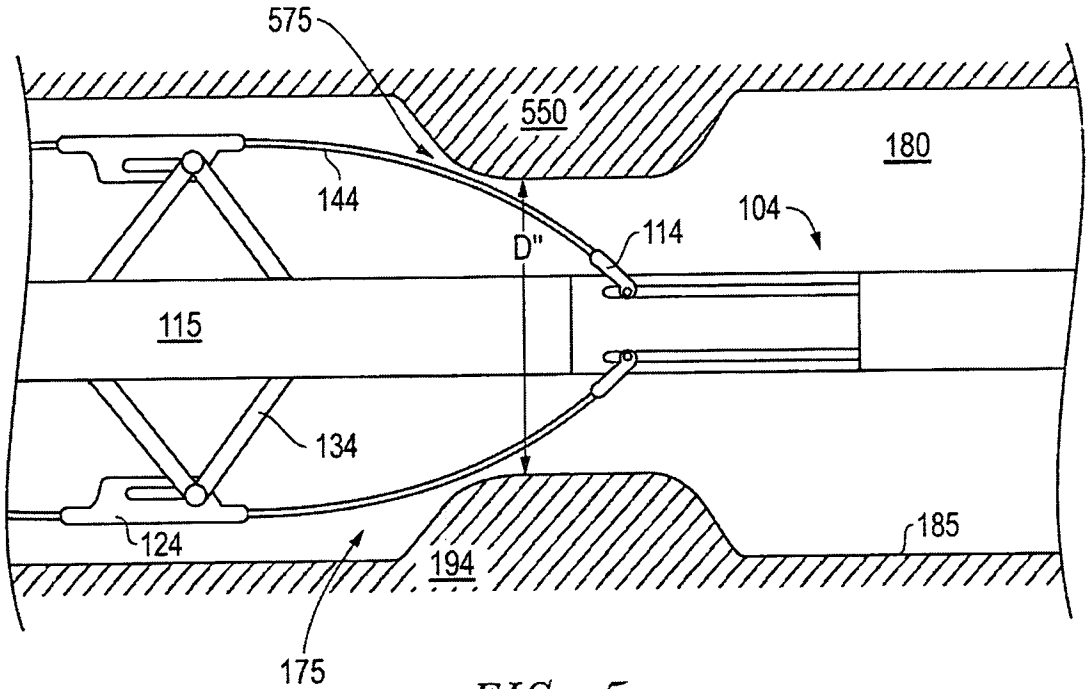
FIG. 5 is an enlarged cross-sectional view of the downhole sonde disposed adjacent a restriction of the open-hole well of FIG. 1.

Referring now to FIG. 5, the downhole sonde 175 is shown advanced further into the well 180 reaching a restriction 550. As described here, the term "restriction" is meant to refer to the presence of a feature that carries with it a sudden reduction in well diameter (D"). For example, given the open-hole nature of the well 180 depicted in FIG. 5, the restriction 550 may be a natural build-up of stable formation debris. However, in other circumstances, valves or other hydrocarbon well features may be pre-positioned downhole. Regardless, the well diameter (D") may shrink in a sudden manner as indicated such that the bowsprings 144 make contact with the restriction 550, such as at midpoint 575, in absence of the gripping saddles 124. That is, there may be a sudden emergence of force translated through the bowsprings 144 from a non-axial location (e.g. outside of the gripping saddles 124). Nevertheless, biasing toward such a location may be effectively achieved.

Figure 6:
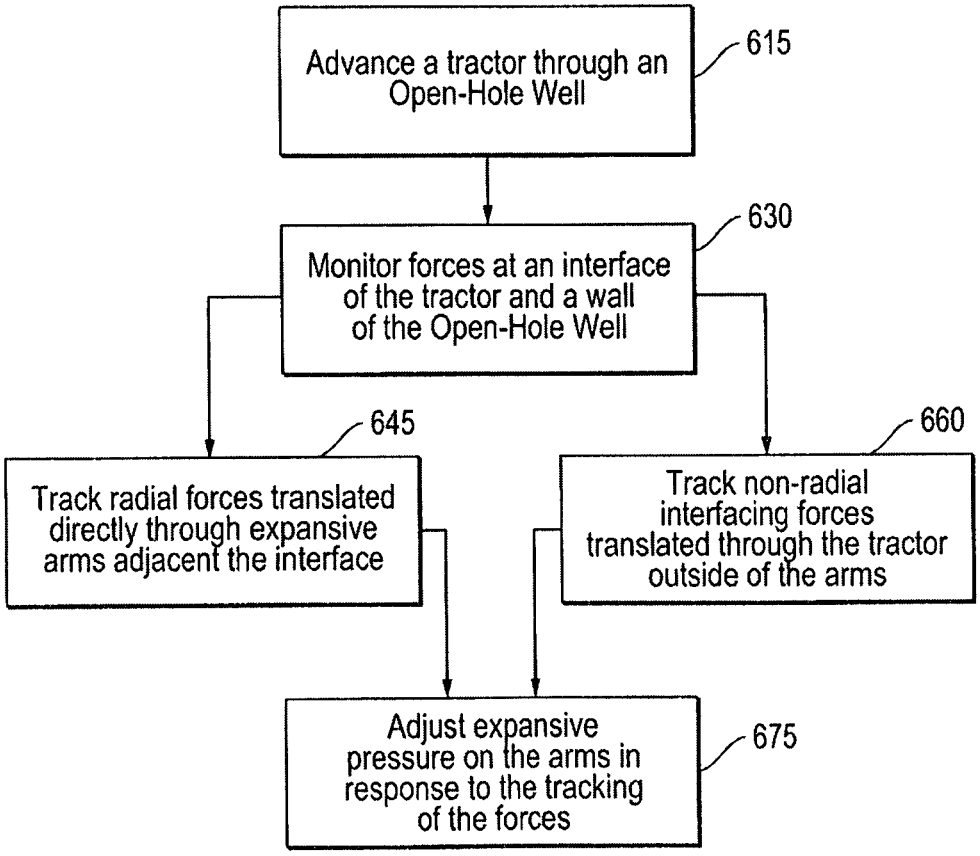
FIG. 6 is a flow-chart summarizing an embodiment of employing a force monitoring tractor in an open-hole well.

Referring now to FIG. 6, a flow-chart is depicted summarizing an embodiment of employing a force monitoring tractor in an open-hole well. The tractor may be advanced in the well as indicated at 615 while forces that are translated through the tractor relative to the wall of the well are continuously monitored as indicated at 630. This monitoring may provide a host of information relative to the well, tractor positioning therein, etc.

Monitoring of forces relative to the interface may also involve the tracking of truly radial forces that are translated directly through expansive arms that extend from a central elongated body of the tractor as noted at 645. This is detailed herein with reference to FIG. 3 and the tracking of forces that are translated through radially expansive arms (e.g. 134).

Alternatively, monitored forces at the interface may involve the tracking of forces that are imparted through the tractor without primarily being directed through the radially expansive arms (e.g. non-radial forces) as noted at 660. An example of monitoring of such forces is detailed herein with respect to FIG. 5.

Regardless of the particular type or combination of monitoring employed, the information obtained may be employed to adjust expansive pressure on the arms as indicated at 675. In this manner, the forces present at the interface of the tractor and the exposed surface of the open hole well may be regulated in a manner that optimizes tractoring while preserving the structural integrity of the formation as much as possible.

Embodiments detailed hereinabove provide techniques and assemblies that allow for tractoring in an open hole well in a manner that address concern over forces present at the interface of the tractor and the wall of the well. Such forces may be monitored and controlled in a manner that promotes the life of the tractor as well as the structural integrity of the exposed well wall surface.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. As such, the foregoing description should not be read as pertaining only to the precise structures described and shown in the accompanying drawings, but rather should be read as consistent with and as support for the following claims, which are to have their fullest and fairest scope.

We claim:

1. A method of tractoring in an open hole well, the method comprising:

providing pressure to a chamber located within an elongated body of a tractor to move a piston, thereby expanding a bowspring into contact with a wall of an open hole well;

acquiring data on the pressure of fluid in the chamber;

sending the data on the pressure of fluid in the chamber to a processor connected with the elongated body, wherein the processor interpolates the data on the pressure of fluid in the chamber to estimate force translating through the bowspring, and compares the estimated force to a predetermined force; and releasing fluid from the chamber when the estimated force exceeds the predetermined force.

2. The method of claim 1, further comprising communicating the estimated force to surface, and determining wellbore diameter from the estimated force and comparing the wellbore diameter to a predetermined map of the well to identify the location of the tractor.

3. The method of claim 1, further comprising maintaining pressure in the chamber below the predetermined pressure during a power stroke of the tractor.

4. The method of claim 3, wherein maintaining pressure in the chamber below the predetermined pressure during a power stroke of the tractor comprises the processor directing a release of fluid from the chamber when the estimated force is above the predetermined force and directing the addition of fluid into the chamber when the estimated force is below a predetermined minimum force.

5. A downhole tractor for positioning in an open hole well, the tractor comprising:

an elongated body;

a driving mechanism connected with the elongated body, wherein the driving mechanism is configured to radially expand to contact a wall of an open hole well;

a chamber located in the body, wherein the chamber is configured to selectively receive fluid and release pressure;

a piston located in the chamber, wherein the piston is operatively connected with the drive mechanism for radially expanding the drive mechanism;

a pressure sensor in communication with the chamber; and a processor in communication with the pressure sensor; wherein the processor is configured to interpolate pressure data to estimate force translating through the drive mechanism, compare the estimated force to a predetermined force, and direct release of pressure from the chamber when the estimated force exceeds a predetermined force.

6. The tractor of claim 5, wherein the processor is further configured to direct the addition of fluid to the chamber when the estimated force is below a predetermined minimum force.

7. The tractor of claim 5, wherein the driving mechanism is a bowspring.

8. The tractor of claim 5, wherein the driving mechanism is a gripping saddle.

9. The tractor of claim 8, wherein the gripping saddle is connected with a radially expandable arm, and wherein the radially expandable arm is connected with the piston.

10. The tractor of claim 8, wherein a linkage wheel connects the gripping saddle to the radially expandable arm.

* * * * *